US005933166A

United States Patent [19]

Andrews et al.

[11] Patent Number: 5,933,166

[45] Date of Patent: Aug. 3, 1999

[54] INK-JET PRINTHEAD ALLOWING SELECTABLE DROPLET SIZE

[75] Inventors: John R. Andrews, Fairport; Peter A. Torpey, Webster; Cathie J. Burke, Rochester, all of N.Y.

[73] Assignee: Xerox Corporation, Stamford, Conn.

[21] Appl. No.: 08/794,247

[22] Filed: Feb. 3, 1997

[51] Int. Cl.[6] ..... B41J 2/05

[52] U.S. Cl. ..... 347/62; 347/206

[58] Field of Search ..... 347/62, 15, 204, 347/206

[56] References Cited

U.S. PATENT DOCUMENTS

| | | | |
|---|---|---|---|
| 4,251,824 | 2/1981 | Hara et al. | 347/15 |
| 4,740,796 | 4/1988 | Endo et al. | 347/56 |
| 4,870,433 | 9/1989 | Campbell | 347/62 |
| 4,935,752 | 6/1990 | Hawkins | 347/62 |
| 4,947,189 | 8/1990 | Braun | 347/62 |
| 5,204,689 | 4/1993 | Shirato | 347/62 X |
| 5,481,287 | 1/1996 | Tachihara | 347/62 |

FOREIGN PATENT DOCUMENTS

| | | | |
|---|---|---|---|
| 3-15563 | 1/1991 | Japan | B41J 2/345 |
| 3-240545 | 10/1991 | Japan | B41J 2/05 |
| 3-293165 | 12/1991 | Japan | B41J 2/345 |
| 4-52148 | 2/1992 | Japan | B41J 2/345 |

OTHER PUBLICATIONS

Xerox Disclosure Journal, vol. 16, No. 2, p. 91.

*Primary Examiner*—Joseph Hartary
*Attorney, Agent, or Firm*—R. Hutter

[57] ABSTRACT

A thermal ink-jet printhead includes ejectors wherein a heating surface is disposed within a channel retaining liquid ink. The heating element within each ejector includes a converter for converting applied electrical energy to heat energy, and a distributor, for distributing the heat energy over a portion of the heating surface. The structure of the heating element allows the effective area of nucleation within the heating area, the size of which directly affects the volume of the ejected liquid ink droplet, to be varied with voltage and/or pulse width.

17 Claims, 4 Drawing Sheets

INK-JET PRINTHEAD ALLOWING SELECTABLE DROPLET SIZE

FIELD OF THE INVENTION

The present invention relates to a printhead for a thermal ink-jet printer, in which droplets of selectable sizes may be ejected.

BACKGROUND OF THE INVENTION

In thermal ink-jet printing, droplets of ink are selectably ejected from a plurality of drop ejectors in a printhead. The ejectors are operated in accordance with digital instructions to create a desired image on a print sheet moving past the printhead. The printhead may move back and forth relative to the sheet in a typewriter fashion, or the linear array may be of a size extending across the entire width of a sheet, to place the image on a sheet in a single pass.

The ejectors typically comprise capillary channels, or other ink passageways, which are connected to one or more common ink supply manifolds. Ink is retained within each channel until, in response to an appropriate digital signal, the ink in the channel is rapidly heated by a heating element (essentially a resistor) disposed on a surface within the channel. This rapid vaporization of the ink adjacent the channel creates a bubble which causes a quantity of liquid ink to be ejected through an opening associated with the channel to the print sheet. The process of rapid vaporization creating a bubble is generally known as "nucleation." One patent showing the general configuration of a typical ink-jet printhead is U.S. Pat. No. 4,774,530, assigned to the assignee in the present application.

In ink-jet printing, it has been difficult to create an apparatus in which the size of a droplet ejected by a particular ejector can be selected. Generally, ejectors in thermal ink-jet printheads are capable of ejecting a droplet of generally one size only. However, there exist any number of printing situations where it would be desirable to be able to have a single ejector capable of selectably emitting a droplet of one of a plurality of selectable droplet sizes. Such situations in which a selectable droplet size would be highly useful include creation of half-tone images such as derived from photographs, and the creation of offset-quality alphanumeric characters.

DESCRIPTION OF THE PRIOR ART

In the prior art, U.S. Pat. No. 4,251,824 discloses a thermal ink-jet printhead wherein each ejector includes a plurality of independently-controlled heating elements. By selecting a particular combination of elements, one can select the size of the ejected droplet. A similar principle is disclosed in the *Xerox Disclosure Journal,* Vol. 6, No. 2, page 91. U.S. Pat. No. 4,740,796 discloses basic principles of bubble nucleation in ink-jet printing. It is also generally known that one technique for manipulating the size of ink droplets is to control the temperature of the liquid ink just before nucleation, such as by preheating the liquid ink to a predetermined temperature which will yield a known droplet size.

SUMMARY OF THE INVENTION

According to the present invention, there is provided an ink-jet printing apparatus. A structure defines a channel that retains a quantity of liquid ink therein. A heating element adjacent the channel includes a converter, for converting electrical energy applied thereto to heat energy, and a distributor defining a heating surface within the channel. The distributor dissipates heat energy from the converter through the heating surface into the channel, thereby nucleating a bubble in liquid ink in the channel. The distributor has a different resistivity than the converter.

DETAILED DESCRIPTION OF THE INVENTION

Figure 1:
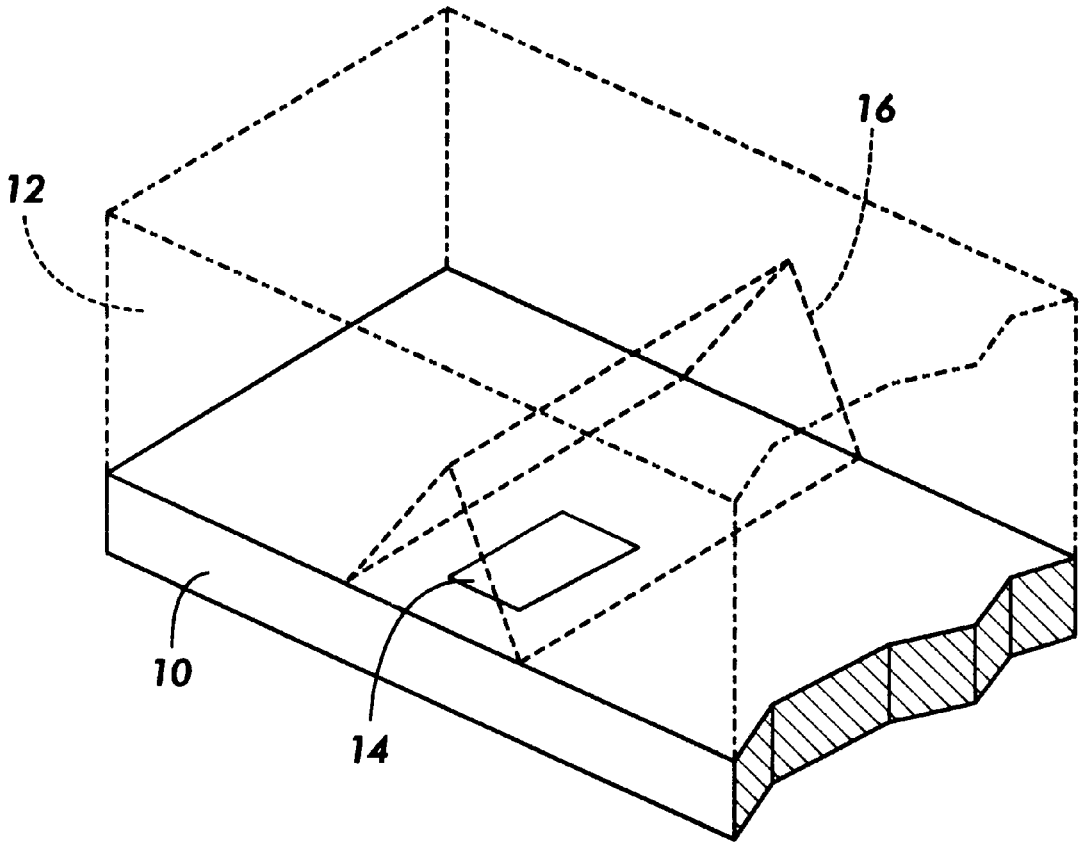
FIG. 1 PRIOR ART
FIG. 1 is a simplified perspective view showing the basic elements of a thermal ink-jet ejector as would be used with the present invention.

FIG. 1 is a highly simplified perspective view showing the portions of an ejector for a thermal ink-jet printhead incorporating the present invention. Although only one ejector is shown, it will be understood that a practical thermal ink-jet printhead will include 100 or more such ejectors, typically spaced at 300 to 600 ejectors per inch. Illustrated in FIG. 1 is the general configuration of what is known as a "side-shooter" printhead wherein the channels forming the ejectors are created between two chips which are bound together. The printhead shown in FIG. 1 comprises a heater chip 10, which is bound on a main surface thereof to a "channel plate" indicated in phantom as 12. The heater chip 10 is generally a semiconductor chip design as known in the art, and defines therein any number of heating elements, such as indicated as 14, on a main surface thereof. There will typically be provided one heating element 14 for every ejector in the printhead. Adjacent each ejector 14 on the main surface of heater chip 10 is a channel 16 which is formed by a groove in channel plate 12. Channel plate 12 can be made of any number of ceramic, plastic, or metal materials known in the art. When the chip 10 is abutted against the channel plate 12 each channel 16 forms a complete channel with the adjacent surface of the heater chip 10, and one heating element 14 disposes a heating surface on the inside of the channel so formed, as shown in FIG. 1.

FIG. 1 shows a highly simplified version of a practical thermal ink-jet printhead, and that any number of ink supply manifolds, intermediate layers, pit layers, etc., would be provided in a practical printhead. However, what is illustrated in FIG. 1 are the essential elements necessary to practice the present invention, and the addition of further elements to make a fully practical printhead will not detract from the claimed invention as described in detail below.

In operation, an ink supply manifold (not shown) provides liquid ink which fills the capillary channel 16 until it is time to eject ink from the channel 16 onto a print sheet. In order to eject a droplet of ink from channel 16, a small voltage is applied to heating element 14 in heater chip 10. As is familiar in the art of ink-jet printheads, heating element 14 is typically largely an area of heater chip 10 which is doped to a predetermined resistivity. Because heating element 14 is essentially a resistor, heating element 14 dissipates power in the form of heat through its heating surface (the heating surface being defined as the surface of heating element 14 disposed within channel 16), thereby vaporizing liquid ink immediately adjacent the heating surface. This vaporization creates a bubble of ink vapor within the channel, and the expansion of this bubble in turn causes liquid ink to be expelled out of the channel 16 and onto a print sheet to form a spot in a desired image being printed. As shown in the view of FIG. 1, it is intended that the ink supply manifold be disposed behind the printhead, so that the ejected ink droplet will be ejected out of the page according to the perspective of FIG. 1.

Figure 2A:
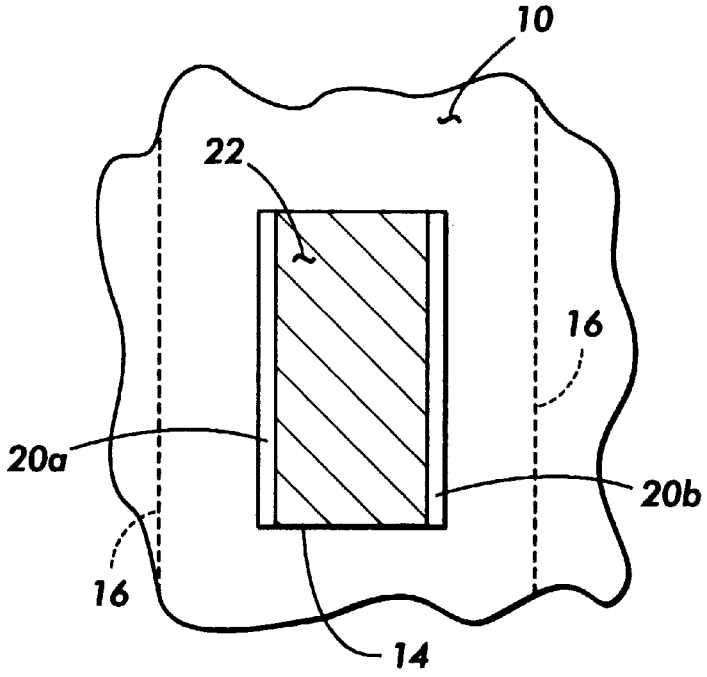
FIG. 2A is a plan view.

FIG. 2A is a plan view of a portion of the main surface of heater chip 10, showing in detail the heating surface provided by one heating element 14, as would be found in a single ejector according to the present invention. Also shown in FIG. 2A, in phantom lines, are the borders of the channel 16 in channel plate 12 when it is bound to the main surface of heater chip 10.

According to the present invention, the heating element 14 includes certain specific structures. As shown, there are provided two "converters" 20*a* and 20*b*, each taking up a relatively small amount of surface area within channel 16, with a relatively large "distributor" 22 providing the bulk of the heating surface between the converters 20*a*, 20*b*. For purposes of the claims below, a "converter" is a structure that converts electrical energy applied thereto to heat energy which is ultimately usable to nucleate liquid ink in the channel 16; a "distributor" 22 is a structure which distributes or dissipates heat energy created by the converters such as 20*a*, 20*b*. In practical terms, converters 20*a*, 20*b* are electrodes to which electrical energy is applied, while distributor 22 is a generally heat-conductive structure.

Figure 2B:
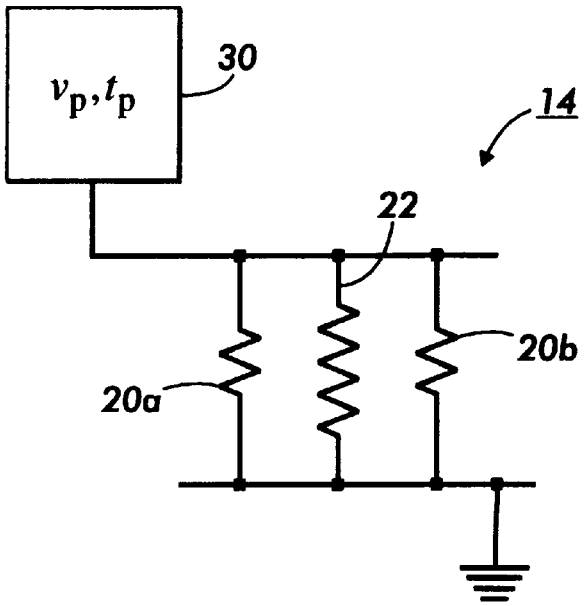
FIG. 2B is a schematic rendering, of a heating element according to one embodiment of the present invention.

FIG. 2B is a schematic rendering of the heating element 14 shown in FIG. 2A. The overall structure of heating element 14 is of three resistors in parallel. Converters 20*a*, 20*b* are of relatively low resistance, as shown, while the structure of distributor 22 is of a very high resistance, and could indeed be an electrical insulator. It is significant, looking at both FIGS. 2A and 2B, that the converters 20*a*, 20*b* are zones of relatively low resistance around portions of the perimeter of the heating area generally formed by distributor 22 within channel 16. When a voltage is applied to the three resistors in parallel, as in FIG. 2B, most of the electrical power will conduct through the converters 20*a*, 20*b*, and relatively little will pass through distributor 22. The function of distributor 22 is not so much to convert applied electrical energy to heat energy, which is the function of converters 20*a*, 20*b*, but rather to act as a distributor of the heat generated by converters 20*a*, 20*b*.

In thermal ink-jet printing, the size of a particular spot of ink created within one ejection from an ejector is dependent on the volume of liquid ink that is ejected from the ejector. In turn, the size of the droplet of ink which is ejected from each ejector is largely dependent on the volume of a bubble of vaporized (nucleated) ink within the channel. The size of the nucleated bubble is in large part a function of size of the heating surface available within a channel such as 16: in general terms, the larger the effective heating surface within channel 16, the larger the resulting bubble of vaporized ink will result, and the larger the volume of liquid ink will be ejected. It is a function of the heating element of the present invention to be able to influence the effective size of the heating area, thereby enabling control of the size of the nucleated ink bubble, and thereby controlling volume of the ejected ink droplet.

Figure 3:
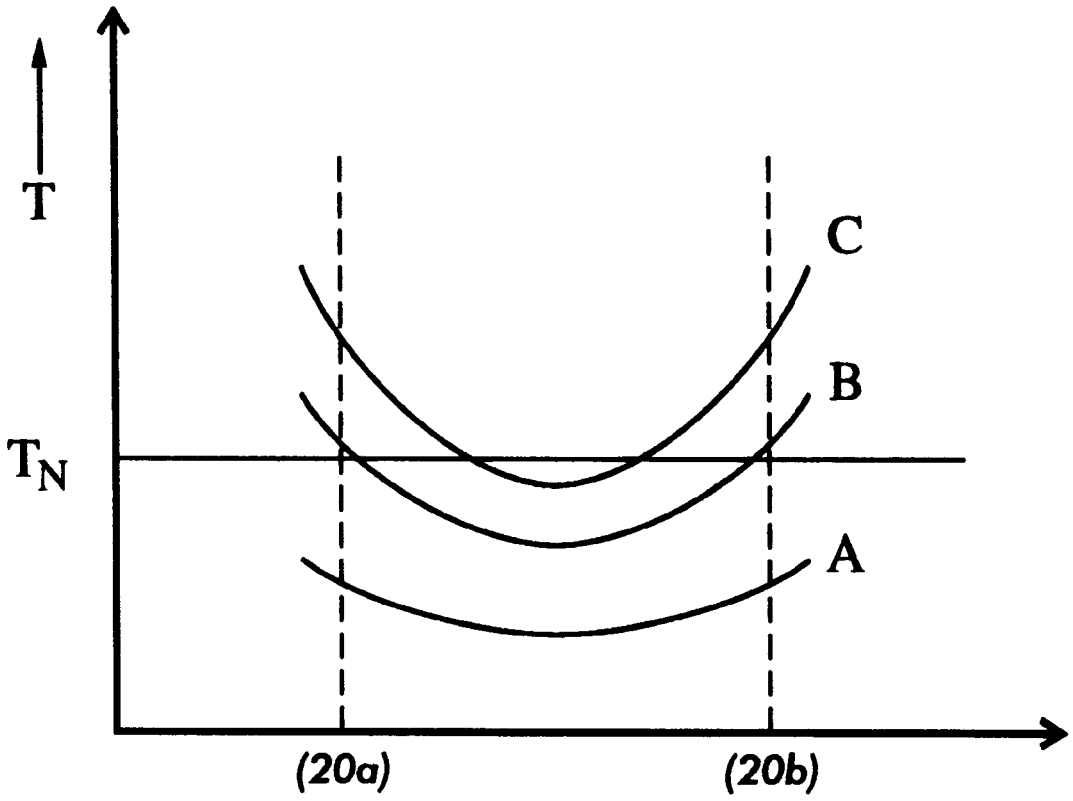
FIG. 3 is a graph showing resulting temperatures under various conditions in a heating element such as shown in FIG. 2A, as a function of distance from the heating element.

FIG. 3 is a graph illustrating the operating principle of the present invention. The x-axis of the graph represents the distance along a path across heating element 14 (horizontally in the view of FIG. 2A) from converter 20*a* to converter 20*b*, while the y-axis represents the resulting temperature along this path under given conditions. Along the y-axis is shown a line marked $T_N$, which represents the boiling temperature, or nucleation temperature, of a typical kind of liquid ink used in ink-jet printing, in order to create the desired bubble of vaporized ink. Nucleation will occur only in those areas between converters 20*a* and 20*b* wherein the local liquid ink temperature is above $T_N$.

The three curves shown in FIG. 3 represent the local temperature of liquid ink along the path between converter 20*a* and 20*b* under various particular conditions. In the curve marked A, when a certain voltage is applied to converters 20*a* and 20*b*, the temperature of the liquid ink is higher toward the converters 20*a* and 20*b* than elsewhere, but in no case is the liquid ink in excess of the necessary nucleation temperature $T_N$. The overall profile of curve A, however, shows how distributor 22 distributes heat energy from converters 20*a*, 20*b* across its heating surface.

Curve B represents the profile of temperatures when slightly more energy is applied to the converters 20*a*, 20*b*. Under the conditions of curve B, the power dissipated at converters 20*a* and 20*b* is sufficient to enable a quantity of the ink immediately adjacent each converter to nucleate, as shown by the fact that the curve B exceeds the nucleation temperature $T_N$ in areas relatively close to the converters. Comparing curve B to curve A, the conditions which enable the curve B to exist may be either an increased voltage in the converters 20*a*, 20*b* relative to curve A, and/or a longer "pulse width" for the conditions of curve B, that is, for every ejection event, the requisite voltage is applied to converters 20*a*, 20*b* for a longer period of time.

Turning to curve C, higher power applied to converters 20*a*, 20*b* pushes a great deal of the curve over $T_N$, which means that a relatively large quantity of liquid ink in the vicinity of converters 20*a*, 20*b* is nucleated. The relatively large amount of nucleation will thus result in a relatively large volume of the ejected ink droplet. In brief, the higher the curve as shown in FIG. 3, the larger the resulting vapor bubble in the channel 16, and therefore the larger the droplet ejected.

According to the present invention, the various curves represented by A, B, and C in FIG. 3 (or any potential curve in the graph) can be obtained depending on the applied voltage and/or the pulse width: the higher the applied voltage and/or pulse width, the closer the ejection behavior will resemble curve C. According to a preferred embodiment of the present invention, the most useful variable that can be controlled in ejecting ink in an ink-jet printer is the pulse width, leaving applied voltage substantially constant. Thus, the structure of heating element 14, such as shown in FIG. 2A, enables a system in which the pulse width can be varied in order to control the amount of nucleation that occurs with each ejection, and thereby allowing control over the volume of a resulting ink droplet as a function of pulse width. Means for controlling the voltage $v_p$ and/or pulse width $t_p$ are shown as power source 30, and the basic structure of such a power source would be apparent to one of skill in the art.

Although, with the present invention, drop size can theoretically be varied continuously with continuous variations in voltage and/or pulse width, in most currently-practical designs of power supplies for printheads, the voltage and pulse width are varied not continuously but in fixed increments.

Returning to FIG. 2A, the converters 20*a,* 20*b* comprise a material which is, in this particular embodiment, of a relatively low resistance. Preferred materials for the converters 20*a,* 20*b* include high-doped polysilicon or aluminum metallization, which may be coated with protective layers as necessary to prevent corrosion. Also useful for the converters is a silicide, such as silicon doped with a metal such as tantalum and/or platinum. The material for distributor 22 should be one of relatively high resistivity compared to converters 20*a,* 20*b*; simultaneously, the material for distributor 22 should be of a relatively high thermal conductivity. Preferred materials for distributor 22 include tantalum or a relatively low-doped polysilicon. Also useful for the distributor can be a metal or a diamond-like carbon. In overview, converters 20*a,* 20*b* should be good conductors of electricity, thereby facilitating the conversion of electricity to heat energy, whereas the relatively large exposed surface of exposed distributor 22 within channel 16 provide an area through which the resulting heat energy can be dissipated from the heating surface to the liquid ink in channel 16.

In one proposed practical embodiment of a heating element 14 such as shown in FIG. 2A, a heating element 14 which is 200 micrometers long (that is vertically in the view of the Figure) include converters 20*a,* 20*b* which are each approximately 2 micrometers wide (horizontally in the view of the Figure) with the distributor 22 being 18 micrometers wide.

Figure 4A:
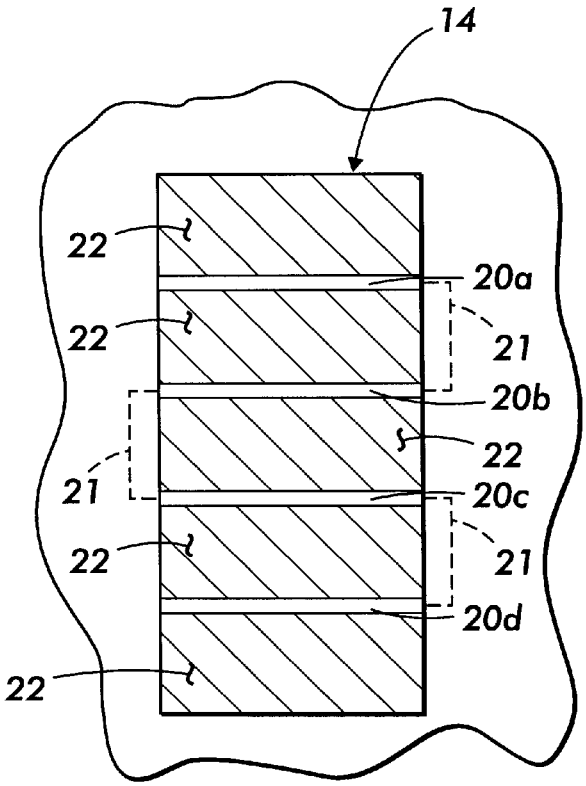
FIG. 4A is a plan view.
Figure 4B:
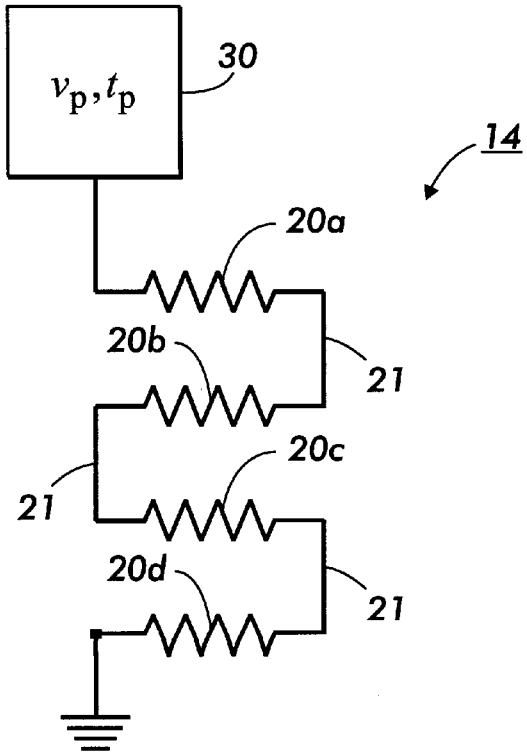
FIG. 4B is a schematic rendering, of a heating element according to an alternate embodiment of the present invention.

FIG. 4A is plan view, and FIG. 4B is a schematic representation, of an alternate, and in some ways preferred, embodiment of the heating element 14 of the present invention. In FIGS. 4A and 4B, compared with 2A and 2B, like reference numerals like functional elements, although there are certain key structural differences. In the heating element 14 shown in FIG. 4A, instead of providing converters such as 20*a* and 20*b* along the perimeter of the heating surface, the converters are arranged as a series of strips which extend across the heating surface. As shown in FIG. 4B, these individual strips, indicated as 20*a*–20*d,* are ultimately connected to a power source 30 in series, as opposed to in parallel in the above-described embodiment.

According to this embodiment of the present invention, the resistance of each strip 20*a*–20*d* is relatively high compared to the surfaces forming the distributor 22, which are interposed between the converters, as shown. Such a structure can be created by, for example, providing a low doping of polysilicon in the areas corresponding to converters 20*a,* 20*b,* relative to polysilicon forming distributor areas 22. Again, in this embodiment, the function of the converters 20*a*–20*d* is to convert a voltage applied thereto to heat energy, while the function of the areas corresponding to distributors 22 is to distribute the heat generated by the converters. Again, the greater the voltage and/or pulse width applied to the converters with each ejection, the greater the area of necessary nucleation temperature $T_N$ will exist on the heating surface formed by heating element 14, and the larger the vapor bubble will result.

In one proposed embodiment of an ejector having a heating element 14 of the general design shown in FIG. 4A, a heating element having an overall length (vertically as viewed in the Figure) of 200 micrometers includes five converters 20*a,* 20*b,* etc. each of a width (vertically as viewed in the Figure) of 2 micrometers. The width of the converters should be less than or equal to 25% of the width of the distributors.

It will be noted, in both the FIGS. 2A–2B and 4A–4B embodiments, that a number of individual vapor bubbles will result with each ejection, generally one bubble for every converter. In most prior-art designs of heating elements for ink-jet printing, it is typical to provide means for creating only one vapor bubble with each ejection. The fact that a plurality of vapor bubbles may be created with each ejection does not have a substantial effect on the overall performance of the ejector, although, in general, it is desirable that all of the resulting vapor bubbles with each ejection be of approximately the same size, so that one of a plurality of resulting vapor bubbles with each ejection does not dominate the others. For the creation of relatively large vapor bubbles, in any case, multiple simultaneous vapor bubbles tend to merge together in the course of ejecting a droplet.

While the invention has been described with reference to the structure disclosed, it is not confined to the details set forth, but is intended to cover such modifications or changes as may come within the scope of the following claims.

We claim:

1. An ink-jet printing apparatus, comprising:

a structure defining a channel, the channel adapted to retain a quantity of liquid ink therein; and a heating element adjacent the channel, including a converter, for converting electrical energy applied thereto to heat energy, the converter including a first resistor and a second resistor, and a distributor defining a heating surface disposed between the first resistor and the second resistor within the channel, the distributor having a primary function of dissipating heat energy from the converter through the heating surface into the channel, thereby nucleating a bubble in liquid ink in the channel, the distributor including a material having a substantially higher resistivity than the converter, the first resistor of the converter being electrically connected in parallel with the second resistor of the converter and the heating element being connected between a power supply and ground.

2. The apparatus of claim 1, the heating surface defining a perimeter within the channel, the first resistor of the converter being disposed along at least a portion of the perimeter of the heating surface.

3. The apparatus of claim 1, the converter comprising a metal conductor.

4. The apparatus of claim 1, the converter comprising polysilicon.

5. The apparatus of claim 1, the converter comprising a silicide.

6. The apparatus of claim 1, the distributor comprising polysilicon.

7. The apparatus of claim 1, the distributor comprising tantalum.

8. The apparatus of claim 1 the distributor comprising carbon.

9. The apparatus of claim 1, the distributor comprising metal.

10. The apparatus of claim 1, the converter being disposed in at least one strip extending across the heating surface.

11. The apparatus of claim 10, the converter having a higher resistivity than the distributor.

12. The apparatus of claim 10, the converter comprising polysilicon.

13. The apparatus of claim 1, further comprising means for varying a pulse width of energy applied to the converter to cause nucleation.

14. The apparatus of claim 1, further comprising means for varying a voltage applied to the converter to cause nucleation.

15. An ink-jet printing apparatus, comprising:

a structure defining a channel, the channel adapted to retain a quantity of liquid ink therein; and a heating element adjacent the channel, including a converter, for converting electrical energy applied thereto to heat energy, and a distributor defining a heating surface within the channel, the distributor having a primary function of dissipating heat energy from the converter through the heating surface into the channel, thereby nucleating a bubble in liquid ink in the channel, the distributor having a substantially higher resistivity than the converter, the converter being disposed in a first resistive strip extending across the heating surface and a second strip extending across the heating surface, the first strip and the second strip being directly electrically connected in series and the heating element being connected between a power supply and ground.

16. The apparatus of claim 15, further comprising means for varying a pulse width of energy applied to the converter to cause nucleation.

17. The apparatus of claim 15, further comprising means for varying a voltage applied to the converter to cause nucleation.

* * * * *